US008683971B2

(12) United States Patent
Miyashita

(10) Patent No.: US 8,683,971 B2
(45) Date of Patent: Apr. 1, 2014

(54) INTAKE MANIFOLD

(71) Applicant: Honda Motor Co., Ltd., Tokyo (JP)

(72) Inventor: Youichi Miyashita, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/668,317

(22) Filed: Nov. 5, 2012

(65) Prior Publication Data

US 2013/0125851 A1 May 23, 2013

(30) Foreign Application Priority Data

Nov. 18, 2011 (JP) ..... 2011-252639

(51) Int. Cl.
*F02M 35/10* (2006.01)

(52) U.S. Cl.
USPC ..... 123/184.21

(58) Field of Classification Search
USPC ..... 123/184.21
See application file for complete search history.

(56) References Cited

U.S. PATENT DOCUMENTS

| | | | | |
|---|---|---|---|---|
| 7,086,365 | B1 * | 8/2006 | Teeter | 123/184.21 |
| 2009/0241886 | A1 * | 10/2009 | Kameda | 123/184.21 |
| 2010/0162984 | A1 * | 7/2010 | Wakamatsu et al. | 123/184.21 |

FOREIGN PATENT DOCUMENTS

| | | |
|---|---|---|
| JP | 2001-521453 | 11/2001 |
| JP | 2003-260737 | 9/2003 |
| JP | 2005-009488 | 1/2005 |
| JP | 2008-297960 | 12/2008 |
| JP | 2009-215896 | 9/2009 |
| JP | 2009-221860 | 10/2009 |
| JP | 2011-163332 | 8/2011 |
| WO | WO 2011/092972 | 8/2011 |

OTHER PUBLICATIONS

Japanese Office Action for corresponding JP Application No. 2011-252639, Jul. 22, 2013.

* cited by examiner

*Primary Examiner* — Lindsay Low
*Assistant Examiner* — Charles Brauch
(74) *Attorney, Agent, or Firm* — Ditthavong Mori & Steiner, P.C.

(57) ABSTRACT

An intake manifold includes a first piece and a second piece. The first piece includes a first branch pipe half portion and an intake air introducing portion. The second piece is connected to the first piece by vibration-welding and includes a second branch pipe half portion, an additional body, and a connecting portion. The second branch pipe half portion is connected to the first branch pipe half portion. The additional body is connected to the intake air introducing portion. The second branch pipe half portion and the additional body are spaced apart from each other at a predetermined distance. The connecting portion connects the second branch pipe half portion to the additional body.

13 Claims, 7 Drawing Sheets

INTAKE MANIFOLD

CROSS-REFERENCE TO RELATED APPLICATIONS

The present application claims priority under 35 U.S.C. §119 to Japanese Patent Application No. 2011-252639, filed Nov. 18, 2011, entitled "Intake Manifold." The contents of this application are incorporated herein by reference in their entirety.

BACKGROUND OF THE INVENTION

1. Field of the Invention

The present disclosure relates to an intake manifold.

2. Discussion of the Background

In a typical automotive multi-cylinder engine, an intake manifold is fastened to the intake port side wall surface of a cylinder head, and fresh air (air or air-fuel mixture) is supplied through this intake manifold to the combustion chamber of each cylinder. Some intake manifolds include an intake air chamber in which fresh air passing through an air cleaner and a throttle body is temporarily stored, and branch pipes that distribute the fresh air in the intake air chamber to the intake port of each cylinder. Intake manifolds are sometimes manufactured by die casting of aluminum alloy. In recent years, intake manifolds have increasingly been manufactured by injection molding of resin in order to reduce weight, cost, and the like.

In the case of resin injection molding, it is difficult to form hollows (flow paths of fresh air) in the intake air chamber and each branch pipe, and so in many cases, pieces molded separately from thermoplastic resin are integrated by vibration welding (see Japanese Unexamined Patent Application Publication No. 2008-297960). For example, the intake manifold of Japanese Unexamined Patent Application Publication No. 2008-297960 is made by integrating first to third pieces by vibration welding. The first piece forms an intake air introducing portion, a surge tank main half, and a branch pipe main half. The second piece forms a surge tank sub-half that is welded to the surge tank main half. The third piece forms a branch pipe sub-half that is welded to the branch pipe main half, and a lid portion that covers an opening formed in the intake air introducing portion. In the case of Japanese Unexamined Patent Application Publication No. 2008-297960, the welded end face of the branch pipe main half and the welded end face of the opening in the first piece are adjacent to each other in the vibrating direction at the time of vibration welding, and are provided at the same position in a direction perpendicular to the vibrating direction. For this reason, in the third piece, the branch pipe sub-half and the lid portion are continuous with each other in the same plane.

In the case of Japanese Unexamined Patent Application Publication No. 2008-297960, since the branch pipe sub-half and the lid portion are continuous with each other in the same plane, the third piece can be a single piece despite the sliding relative to the first piece in the vibration

SUMMARY OF THE INVENTION

According to one aspect of the present invention, an intake manifold includes a first piece and a second piece. The first piece includes a first branch pipe half portion and an intake air introducing portion. Air is to flow to an intake air chamber through the intake air introducing portion. The second piece is connected to the first piece by vibration-welding and includes a second branch pipe half portion, an additional body, and a connecting portion. The second branch pipe half portion is connected to the first branch pipe half portion. The first and second branch pipe half portions define a branch pipe portion through which air is to flow from the intake air chamber to intake ports of cylinders of an engine. The additional body is connected to the intake air introducing portion. The second branch pipe half portion and the additional body are spaced apart from each other at a predetermined distance. The connecting portion connects the second branch pipe half portion to the additional body.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
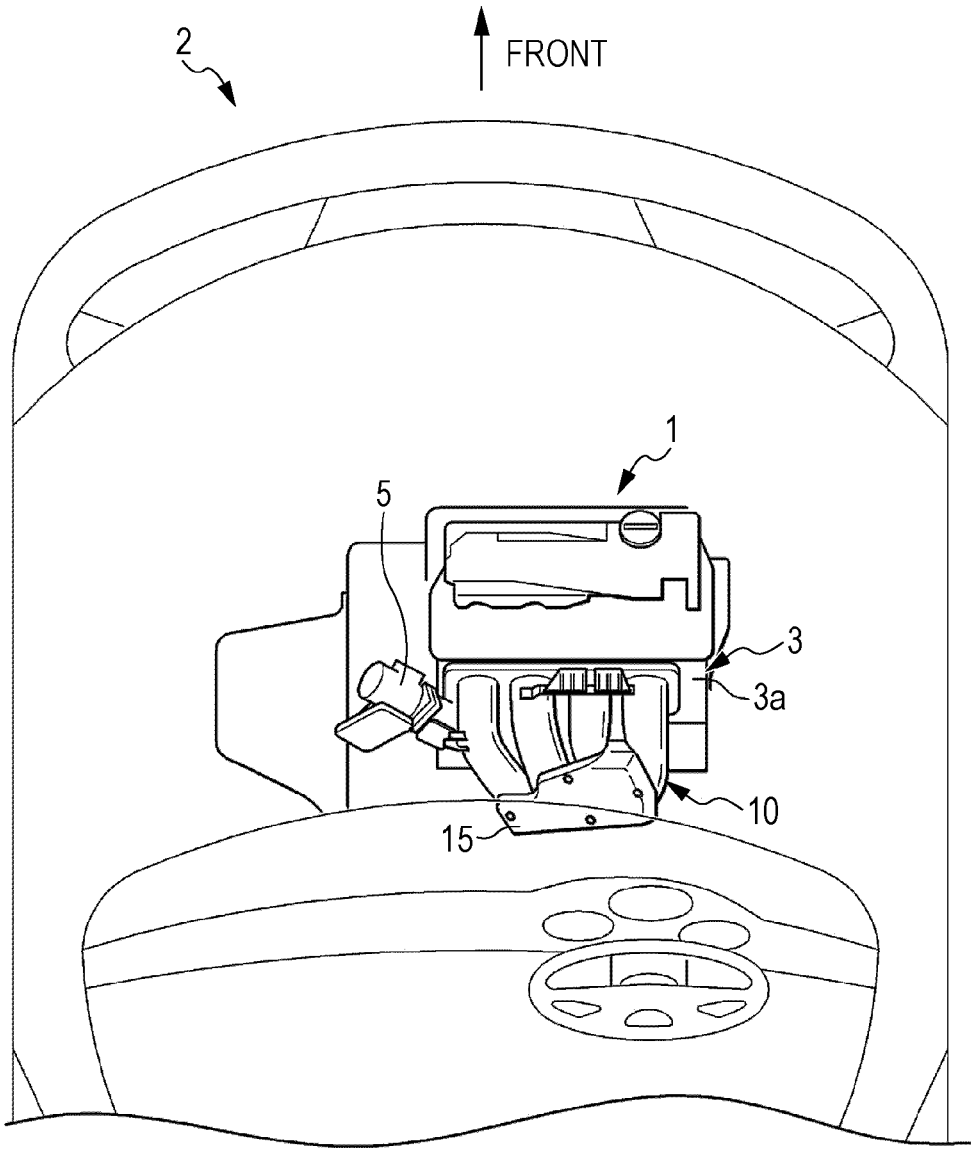
FIG. 1 is a plan view showing the mounted state of an automotive engine according to an embodiment.

The embodiments will now be described with reference to the accompanying drawings, wherein like reference numerals designate corresponding or identical elements throughout the various drawings.

An embodiment in which the present disclosure is applied to an automotive inline-four engine (hereinafter referred to as engine) will be described below in detail with reference to the drawings. In the description of each member, the top, bottom, left, right, front, and rear are indicated by arrows in FIG. 2, and positions and directions are described according to them.

Configuration of Embodiment

As shown in FIG. 1, the engine 1 of this embodiment is mounted in the front of an automobile 2 transversely such that the intake side thereof is located posteriorly, and an intake manifold 10 is fastened to an intake port side wall surface 3*a* of a cylinder head 3. A throttle body 5 is connected to the intake manifold 10, and fresh air from an air cleaner (not shown) is introduced into the intake manifold 10 through the throttle body 5.

Intake Manifold

Figure 2:
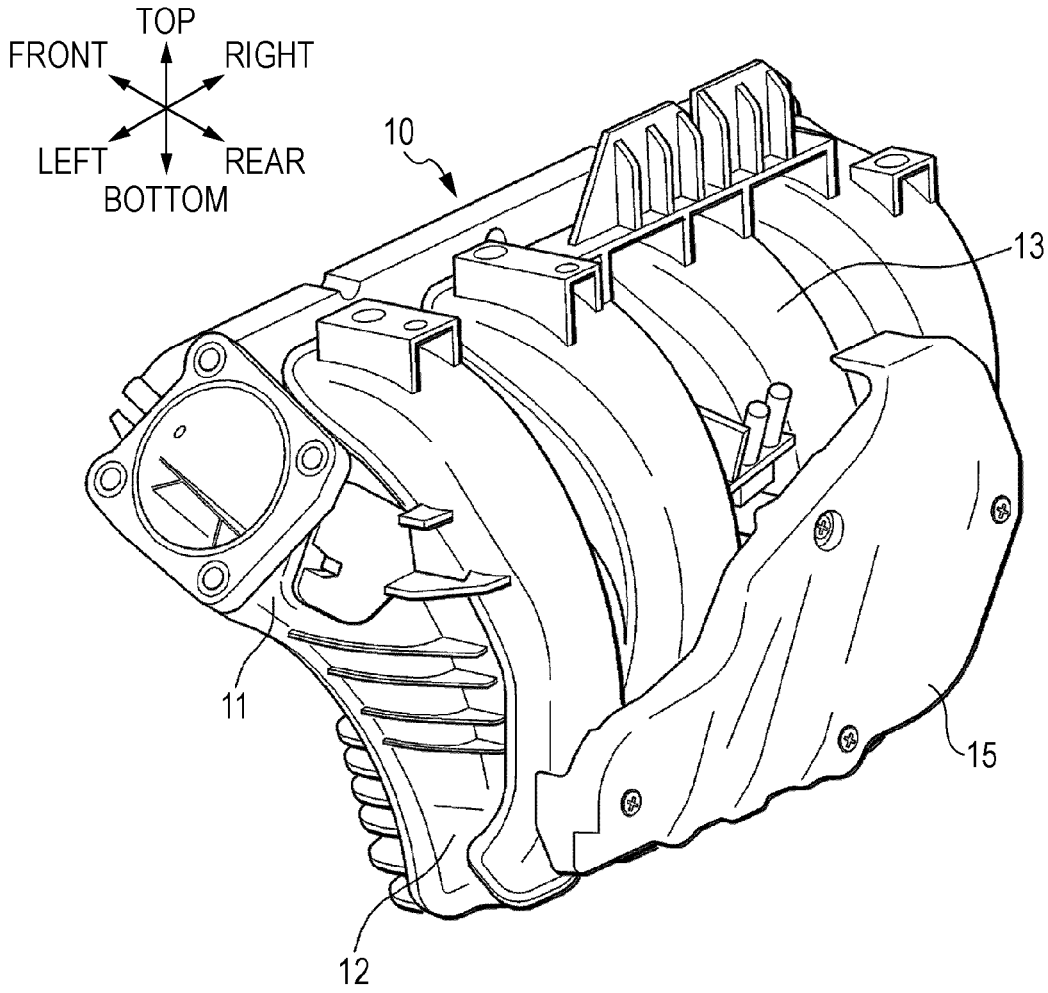
FIG. 2 is a perspective view of an intake manifold according to the embodiment.

As shown in FIG. 2, the intake manifold 10 includes an intake air introducing portion 11 to which the throttle body 5 is fastened, an intake air chamber 12 into which fresh air from the intake air introducing portion 11 flows, and a branch pipe portion 13 that guides the fresh air in the intake air chamber 12 to the intake port (not shown) of each cylinder. A sound insulation cover 15 having a sound absorbing material therein is fastened to the rear surface of the branch pipe portion 13.

Figure 3:
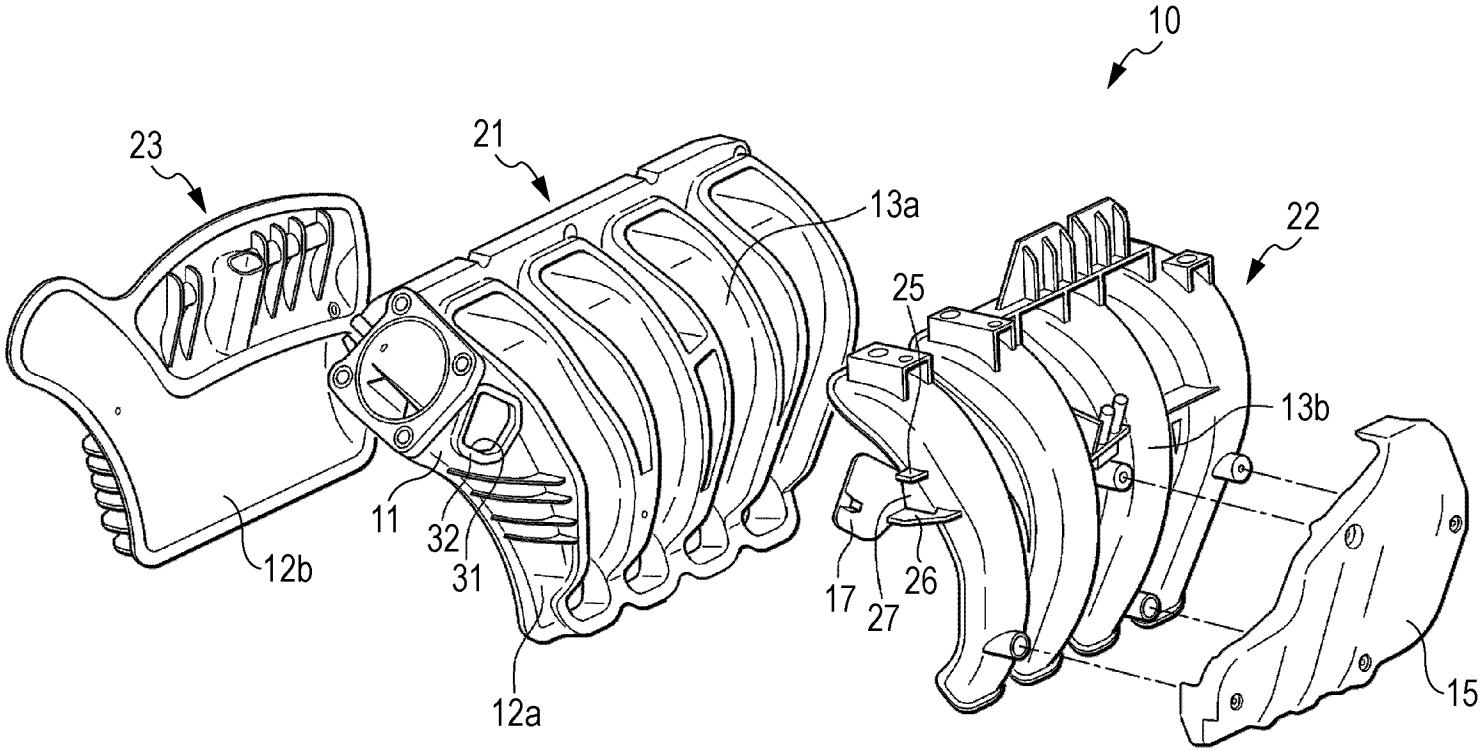
FIG. 3 is an exploded perspective view of the intake manifold according to the embodiment.

As shown in FIG. 3, the intake manifold 10 includes a first piece 21, a second piece 22, and a third piece 23. The first piece 21 has the intake air introducing portion 11, an intake air chamber first half 12*a*, and a branch pipe first half 13*a*. The second piece 22 has a lid 17 (additional body) that is joined to the intake air introducing portion 11, and a branch pipe second half 13*b* that is joined to the branch pipe first half 13*a*. The third piece 23 forms an intake air chamber second half 12*b*. The first to third pieces 21 to 23 are made of thermoplastic resin by injection molding. By joining the second and third pieces 22 and 23 to the first piece 21 by vibration welding, the intake manifold 10 is manufactured.

Figure 4:
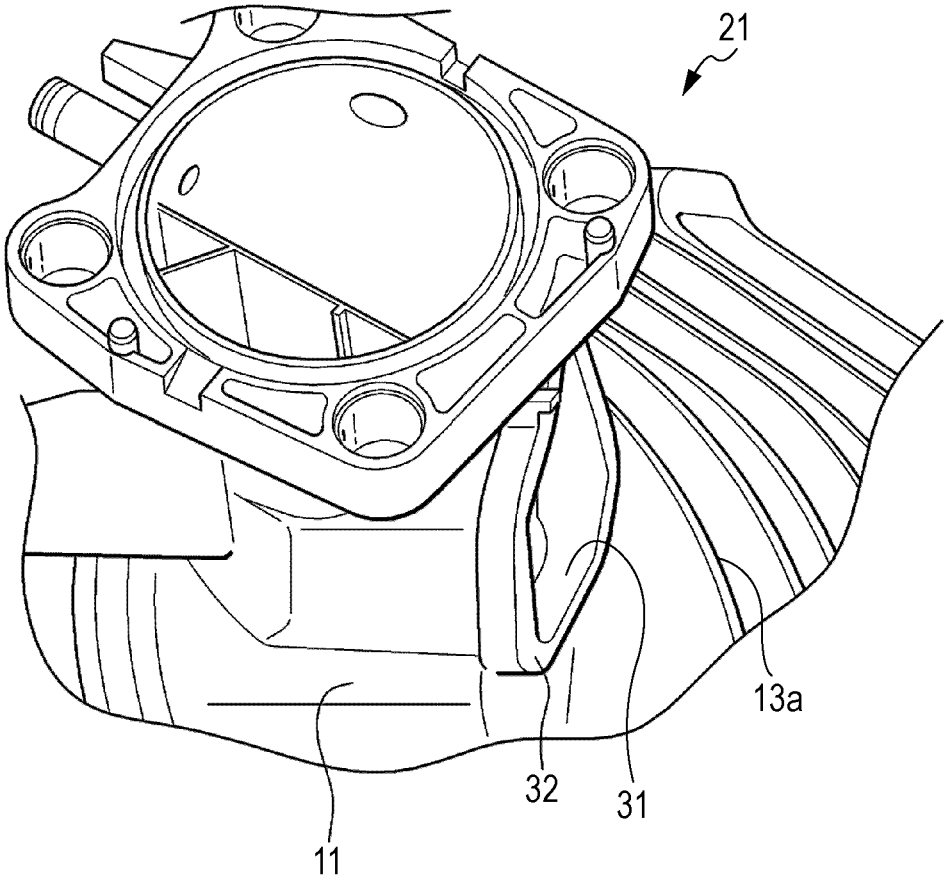
FIG. 4 is a partial enlarged perspective view of a first piece according to the embodiment.
Figure 5:
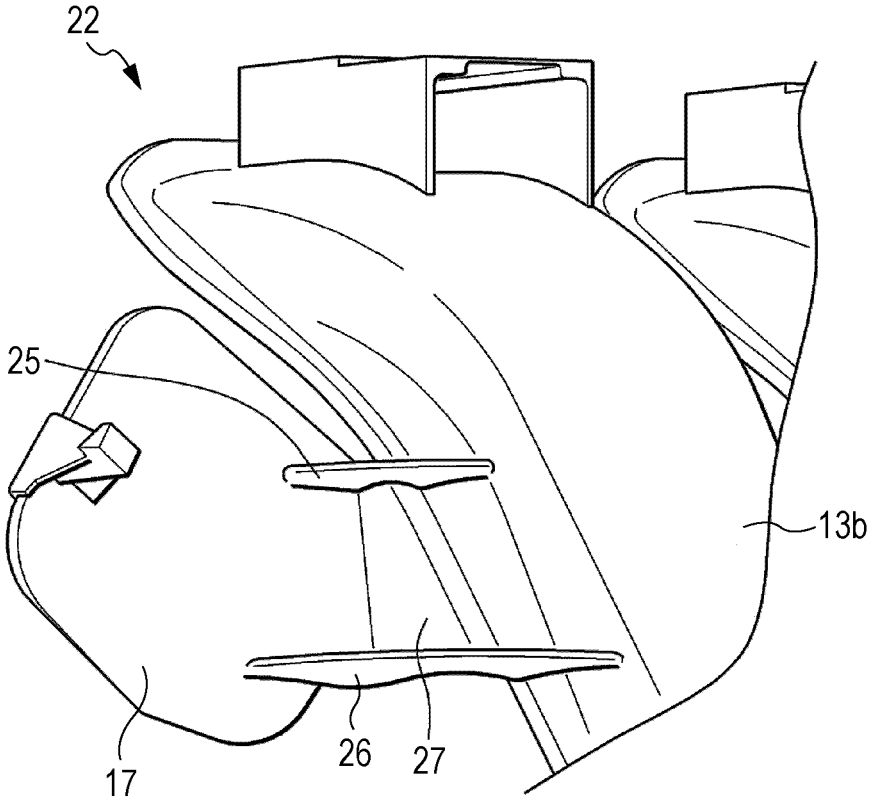
FIG. 5 is a partial enlarged perspective view of a second piece according to the embodiment.
Figure 6:
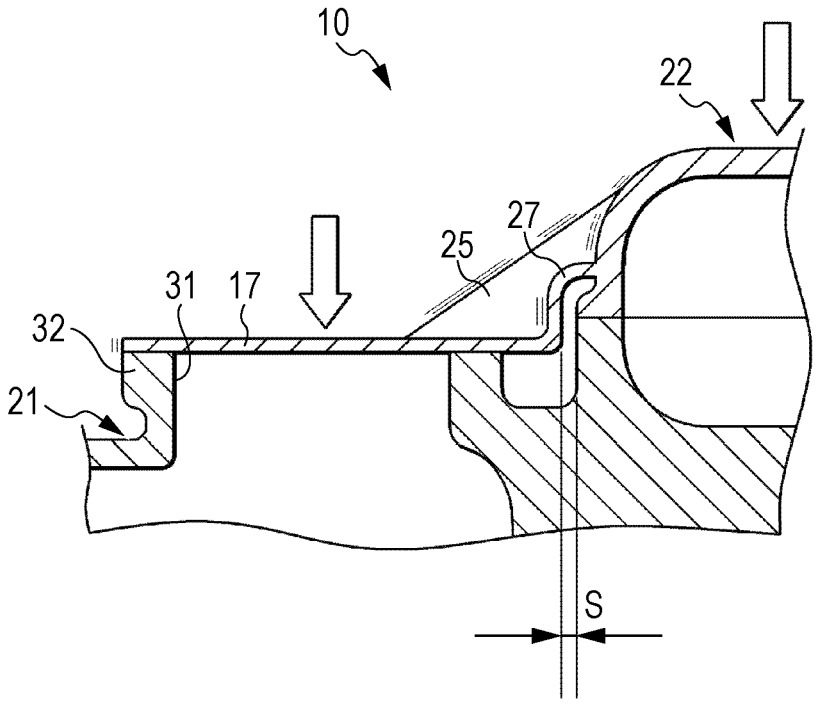
FIG. 6 is a partial enlarged transverse sectional view of the intake manifold according to the embodiment.

As shown in FIG. 4, an opening portion 32 having a mold opening 31 is formed in the intake air introducing portion 11 of the first piece 21 in order for a divided mold to be inserted at the time of injection molding. The opening portion 32 is located at a position one level lower than the rear end face of the branch pipe first half 13*a*. The opening portion 32 is at a distance from the branch pipe first half 13*a* also in the left-right direction. The lid 17 of the second piece 22 covers the opening portion 32 (the mold opening 31) of the first piece 21. As shown in FIG. 5 and FIG. 6, the lid 17 is located at a position one level lower than the front end face of the branch pipe second half 13*b* (that is, at a distance in a direction perpendicular to the vibrating direction of vibration welding described later), and is at a distance from the branch pipe second half 13*b* also in the left-right direction (that is, the vibrating direction).

In the case of this embodiment, the branch pipe second half 13*b* and the lid 17 are connected by a pair of (upper and lower) connecting ribs 25 and 26 extending in the pressing direction at the time of vibration welding, and the connecting ribs 25 and 26, the branch pipe second half 13*b*, and the lid 17 are connected to each other by a connecting wall 27. As shown in FIG. 6, in a finished state of the intake manifold 10, a predetermined gap S is provided between the connecting ribs 25 and 26 and the connecting wall 27, and the first piece 21.

Operation of Embodiment

Figure 7:
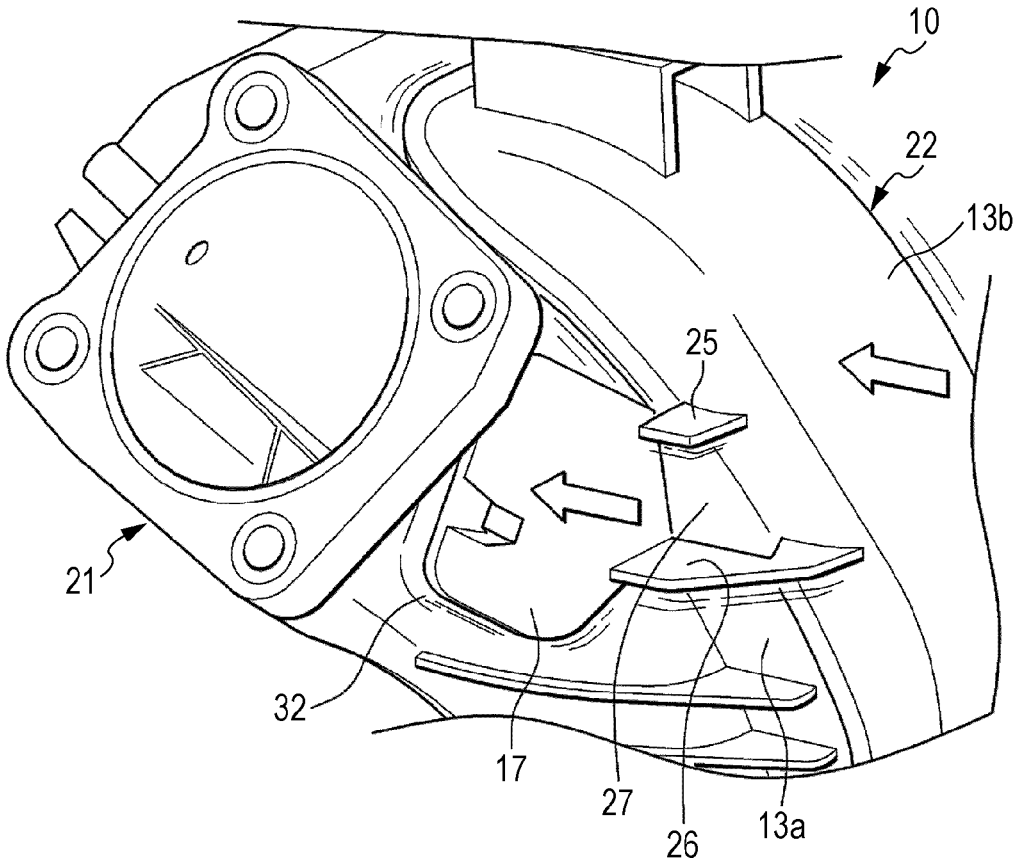
FIG. 7 is a partial enlarged perspective view showing a process of vibration-welding the first and second pieces according to the embodiment.

When the first piece 21 and the second piece 22 are joined in the manufacturing line of the intake manifold 10, the second piece 22 held by a vibrating jig is pressed against the first piece 21 held by a fixing jig, and the second piece 22 is vibrated at a predetermined frequency (for example, 100 to 300 Hz). At this time, the branch pipe second half 13*b* and the lid 17 are pressed against the branch pipe first half 13*a* and the opening portion 32, respectively, as indicated by hollow arrows in FIG. 6 and FIG. 7, and are vibrated in orbital mode (circular motion mode) or linear mode (linear motion mode). The pressure contact surfaces of the first piece 21 (the branch pipe first half 13*a* and the opening portion 32) and the second piece 22 (the branch pipe second half 13*b* and the lid 17) melt owing to the frictional heat, and the pieces 21 and 22 are firmly integrated.

In the case of this embodiment, the branch pipe second half 13*b* and the lid 17 are strongly connected by the connecting ribs 25 and 26 and the connecting wall 27, and therefore hardly move relative to each other in the left-right direction and the top-bottom direction when an external force (for example, the frictional force between the first piece 21 and the second piece 22) acts on them. Therefore, when the second piece 22 is vibrated, the branch pipe second half 13*b* and the lid 17 are joined to the branch pipe first half 13*a* and the opening portion 32 without moving relative to each other. In addition, since a gap S (see FIG. 6) significantly larger than the vibration amplitude of vibration welding is provided between the connecting ribs 25 and 26 and the connecting wall 27, and the first piece 21, the connecting ribs 25 and 26 and the connecting wall 27 do not collide with the first piece 21 at the time of vibration and smooth vibration welding is not interfered with.

The present disclosure now being fully described with reference to the specific embodiment, it is to be understood that the present disclosure is not limited to the above-described embodiment. Although in the above-described embodiment, the present disclosure is applied to an intake manifold of an automotive inline-four engine, the present disclosure is of course applicable also to an intake manifold of an inline-six engine, V-six engine, or the like used in an automobile, industrial machine, or the like. Although in the above-described embodiment, a lid that covers the intake air introducing portion serves as an additional body, instead of the lid, a bracket, a pipe, or the like may serve as an additional body. Although in the above embodiment, the branch pipe second half and the additional body (lid) are connected by a pair of connecting ribs and a connecting wall, they may be connected by three or more connecting ribs. The specific structure, shapes, and the like of the intake manifold and the first and second pieces may also be changed without departing from the spirit of the present disclosure.

In a first aspect of the embodiment, an intake manifold includes an intake air introducing portion and a branch pipe portion and is made by vibration-welding a plurality of pieces. The plurality of pieces include a first piece having a branch pipe first half and an intake air introducing portion, and a second piece having a branch pipe second half joined to the branch pipe first half and an additional body joined to the intake air introducing portion. The branch pipe second half and the additional body are at a predetermined distance from each other and connected by a connecting portion to each other.

According to the first aspect of the embodiment, a branch pipe second half and an additional body are connected by a connecting portion in a second piece, and therefore the branch pipe second half and the additional body are vibration-welded to the first piece without moving relative to each other, and the number of times vibration welding is performed and the number of parts can be reduced even when the manifold second half and the additional body are at a distance from each other.

In a second aspect of the embodiment, an opening for inserting a mold may be provided in the intake air introducing portion, and the additional body may be a lid that covers the opening.

In a third aspect of the embodiment, the connecting portion may include a plurality of connecting ribs that connect the intake air introducing portion and the additional body.

According to the third aspect of the embodiment, the relative displacement between the branch pipe second half and the additional body at the time of vibration welding is effectively suppressed.

In a fourth aspect of the embodiment, the connecting portion may include a connecting wall that connects the intake air introducing portion and the additional body.

According to the fourth aspect of the embodiment, the resin flowability from the branch pipe second half to the additional body at the time of injection molding is improved, and the relative displacement between the branch pipe second half and the additional body at the time of vibration welding is suppressed.

In a fifth aspect of the embodiment, the connecting portion may face the first piece with a predetermined gap therebetween in the vibrating direction at the time of vibration welding.

According to the fifth aspect of the embodiment, the collision between the first piece and the second piece are suppressed, and therefore smooth vibration welding is possible.

In a sixth aspect of the embodiment, the connecting ribs may extend in the pressing direction at the time of vibration welding.

According to the sixth aspect of the embodiment, bending of the additional body due to pressure is less likely to occur, and smooth vibration welding is possible.

Obviously, numerous modifications and variations of the present invention are possible in light of the above teachings. It is therefore to be understood that within the scope of the appended claims, the invention may be practiced otherwise than as specifically described herein.

What is claimed is:

1. An intake manifold comprising:

a first piece comprising:

a first branch pipe half portion; and an intake air introducing portion through which air is to flow to an intake air chamber; and a second piece connected to the first piece by vibration-welding and comprising:

a second branch pipe half portion connected to the first branch pipe half portion, the first and second branch pipe half portions defining a branch pipe portion through which air is to flow from the intake air chamber to intake ports of cylinders of an engine;

an additional body connected to the intake air introducing portion, the second branch pipe half portion and the additional body being spaced apart from each other at a predetermined distance; and a connecting portion connecting the second branch pipe half portion to the additional body, wherein the connecting portion faces the first piece with a predetermined gap between the connecting portion and the first piece in a vibrating direction of vibration-welding, and wherein the connecting portion of the second piece directly connects the second branch pipe half portion of the second piece to the additional body of the second piece.

2. The intake manifold according to claim 1, wherein the intake air introducing portion includes an opening in which a mold is to be disposed at a time of molding of the first piece, and wherein the additional body includes a lid to cover the opening.

3. The intake manifold according to claim 1, wherein the connecting portion includes a plurality of connecting ribs that connect the intake air introducing portion to the additional body.

4. The intake manifold according to claim 1, wherein the connecting portion includes a connecting wall that connects the intake air introducing portion to the additional body.

5. The intake manifold according to claim 3, wherein the connecting ribs extend in a pressing direction of vibration-welding.

6. The intake manifold according to claim 2, wherein the intake air introducing portion includes an annular protruding portion defining the opening and spaced apart from the first branch pipe half portion.

7. The intake manifold according to claim 6, wherein the first branch pipe half portion includes a protruding wall connected to the second branch pipe half portion, and wherein the annular protruding portion is spaced apart from the protruding wall.

8. The intake manifold according to claim 1, further comprising:

a third piece connected to the first piece and provided on an opposite side of the second piece with respect to the first piece, wherein the first and third pieces define the intake air chamber through which air is to flow from the intake air introducing portion to the branch pipe portion.

9. The intake manifold according to claim 1, wherein the second branch pipe half portion, the connecting portion, and the additional body are part of a unitary structure.

10. The intake manifold according to claim 1, wherein the connecting portion includes a plurality of connecting ribs that directly connect the second branch pipe half portion to the additional body.

11. The intake manifold according to claim 1, wherein the connecting portion includes a connecting wall that directly connects the second branch pipe half portion to the additional body.

12. The intake manifold according to claim 1, wherein a contact surface between the first branch pipe half portion and the second branch pipe half portion is disposed on a plane different from a plane on which a contact surface between the additional body and the intake air introducing portion is disposed.

13. The intake manifold according to claim 1, wherein the second branch pipe half portion includes a first contact surface at which the second branch pipe half portion contacts the first branch pipe half portion, wherein the additional body includes a second contact surface at which the additional body contacts the intake air introducing portion plane, and wherein the second contact surface is disposed on a plane different from an adjacent portion of the first contact surface.

* * * * *